US005245808A

United States Patent [19]

Grunewald et al.

[11] Patent Number: 5,245,808

[45] Date of Patent: Sep. 21, 1993

[54] RETAINER AND WEATHERSEAL FOR STRUCTURALLY BONDED GLAZING

[75] Inventors: Fred A. Grunewald, Roswell, Ga.; Dean C. DeBoy, Visalia, Calif.; Wayne E. Whitmyer, Lilburn, Ga.

[73] Assignee: Kawneer Company, Inc., Norcross, Ga.

[21] Appl. No.: 653,983

[22] Filed: Feb. 11, 1991

Related U.S. Application Data

[63] Continuation of Ser. No. 444,666, Dec. 1, 1989, abandoned.

[51] Int. Cl.[5] ..... E04H 1/00

[52] U.S. Cl. ..... 52/235; 52/400; 52/395; 52/398; 52/486

[58] Field of Search ..... 52/208, 235, 309, 395, 52/398, 399, 400, 401, 403, 461, 463, 464, 466, 467, 468

[56] References Cited

U.S. PATENT DOCUMENTS

| | | | |
|---|---|---|---|
| 2,124,354 | 7/1938 | Plym | 52/401 X |
| 3,866,374 | 2/1975 | Dallen | 52/398 X |
| 3,978,629 | 9/1976 | Echols, Sr. | 52/235 |
| 4,377,926 | 3/1983 | Coulston et al. | 52/395 X |
| 4,464,874 | 8/1984 | Shea, Jr. et al. | 52/398 |
| 4,562,680 | 1/1986 | Sukolics et al. | 52/403 |
| 4,650,702 | 3/1987 | Whitmyer | 52/235 X |
| 4,854,095 | 8/1989 | Michlovic | 52/235 |

FOREIGN PATENT DOCUMENTS

| | | | |
|---|---|---|---|
| 511373 | 5/1952 | Belgium | 52/400 |
| 605788 | 7/1948 | United Kingdom | 52/466 |
| 629843 | 9/1949 | United Kingdom | 52/468 |
| 906074 | 12/1959 | United Kingdom | 52/400 |

*Primary Examiner*—Peter M. Cuomo
*Assistant Examiner*—Michael J. Milano
*Attorney, Agent, or Firm*—Jones & Askew

[57] ABSTRACT

A retainer and weatherseal for structurally bonded glazing, which includes an elongate retainer profile having a generally H-shaped transverse cross section, thereby forming a pair of elongate U-shaped retaining channels; and securing device for securing the profile coextensively along a curtainwall framing member, such that one side of the pair of retaining channels is urged against the framing member. The retainer may be in combination with a curtainwall framing member, which includes a framing member having securing device longitudinally along the outward face of the framing member, for receiving the securing device and which are reciprocally configured, the retainer being secured to the framing member with the securing device interlocked in the securing device. The retainer and framing member combination are utilized in a curtainwall framing system having structurally bonded glazing wherein each of the intermediate vertical framing members of the system include the retainer and framing member.

41 Claims, 3 Drawing Sheets

RETAINER AND WEATHERSEAL FOR STRUCTURALLY BONDED GLAZING

This is a continuation of application Ser. No. 444,666, filed Dec. 1, 1989 now abandoned.

TECHNICAL FIELD

The present invention generally relates to an adhesively glazed curtainwall system and more particularly relates to a butt-glazed curtainwall system including mechanical retention members which retain vertical edges of glass panels while providing minimal sight lines, thus permitting glazing and weathersealing to be accomplished from the interior side of the curtainwall.

BACKGROUND OF THE INVENTION

In building structures, it is often aesthetically desirable to cover large portions of the outside of the structures with as much glass and as little outside framing elements as possible, thereby providing the structures with a smooth and unbroken outside surface appearance. Therefore, it is known in the art to provide a structural adhesive bond between the building structure and the inside surfaces of glass panels to attach the panels to the building structure, thus reducing or eliminating the need for permanent outside retention members. Such bonding configurations are commonly known as "Structural Silicone Glazing" or "SSG" systems.

Typical SSG systems fall into two major classes: two-sided and four-sided. Four-sided SSG systems typically include a plurality of vertical structural mullions in combination with a plurality of horizontal structural mullions, which combine to form a mullion framework having a plurality of panel-shaped openings which are slightly smaller than the glass panels to be supported. The mullion framework is fixed about the exterior of a building structure. Each glass panel is positioned adjacent to the exterior surface of the mullion framework and over a corresponding panel-shaped opening by a plurality of temporary retaining clips, such that the edges of the panel slightly overlap the panel-shaped opening and a small gap exists between the inside surfaces of the glass panel and the framework. Structural adhesive, typically structural silicone, is then applied into the gap. After the silicone adhesive cures, it provides a structural bond between the mullion framework and the glass panel which can completely support the glass panel without any aid from the temporary retaining clips or other outside retention means. For weatherproofing purposes, additional silicone adhesive is then applied from the outside of the building into gaps created by the abutting edges of the adjacent glass panels. Disadvantageously, this "weatherbead" must be applied from the exterior of the building.

Two-sided SSG systems differ in that a structural adhesive bond as described above is provided along two (usually vertical) opposing edges of the glass panels. In two-sided SSG systems, the two edges not being structurally bonded to the mullion framework are retained by other means. This is normally done by conventional window glazing means which enclose the entire edge of the glass panels, thus not providing the smooth continuous appearance of four-sided SSG systems. As in the four-sided SSG systems, additional silicone adhesive must be applied from the outside of the building into the gap created by the abutting edges of the glass panels.

Although such SSG systems are in demand, the cost for such systems is high. As discussed above, in four-sided SSG systems, temporary mechanical retentioners for the glass panels must be installed to allow the structural silicone adhesive to cure, and then must be removed after the curing process. Sealant must then be added to cover holes left behind by the temporary fasteners. As such installation and removal processes must be performed from the exterior of the building structure, these processes are typically labor- and cost-intensive, as scaffolding must be installed to provide access to the exterior of the building. In both two- and four-sided systems, the weatherproofing joint must be installed from the building exterior, and the quality of the weatherproofing joint is highly dependent upon the skill of the field laborer installing the glass and applying the sealant.

Safety is also a concern associated with SSG systems, as high reliance is placed upon structural bonding. The structural adhesive is subject to rupture under certain loading conditions, such as high negative pressure on the lee side of the building during periods of strong winds. Such a rupture can cause a glass panel to fall from a building and crash to the ground, possibly causing catastrophic personal injury and property damage.

Various approaches to overcome the above deficiencies have been proposed, such as that disclosed in U.S. Pat. No. 4,650,702, wherein each pane of glass of the curtainwall system has a prebonded structural interface adhered along at least two of its edges. The structural interface is clipped onto the face of the mullion framework during installation to fasten the pane to the mullion framework. Also disclosed is a non-structural weatherseal between adjacent panels which is installed from the interior side of the curtainwall system.

U.S. Pat. No. 4,562,680 discloses a butt glazing system including a specially configured frame member with a front wall forming an angle of at least 135 degrees. A semicircular channel open along its forward portion is formed at the apex of the angled front wall. A special elongate mullion has a gasket formed along its front edge. The rear of the mullion insert has a T-shaped connector portion formed thereon. The "head" of the T-shaped connector portion is wider than the opening of the front of the semicircular channel, such that the head of the connector can be inserted into the channel only by introducing it at an angle and rotating it into place. When so installed, the mullion insert is held within the semicircular channel as long as it is not permitted to rotate relative to the channel. To install a curtainwall according to this system, a first glazing panel is positioned against the end mullion and the adjacent interior mullion from inside the building. A mullion insert as described is then fastened to a chevron-shaped mullion as described, and pivoted such that the gasket portion of the insert abuts the edge of the first panel. A second panel is then positioned against the opposite side of the mullion insert and against the next adjacent mullion. The glazing procedure is then repeated progressively.

Although such systems include advantages, none have proven so successful as to attain industry acceptance. Therefore, efforts continue to solve this problem.

Thus, there is a recognized need to provide a system for structural silicone glazing wherein glazing and weatherproofing may be accomplished from the interior side of the building.

There is also a need to provide such a system which is easy to install, tolerates non-regular or non-plumb installation of glass, and provides improved safety characteristics.

SUMMARY OF THE INVENTION

As will be seen, the present invention solves the above needs associated with prior art butt-glazed curtainwall systems. Stated generally, the present invention comprises a retainer for accepting edges of glass panels and retaining the edges relative to a framing member, comprising an elongate retainer profile having a generally H-shaped transverse cross section, thereby forming a pair of elongate U-shaped retaining channels, the first of the retaining channels configured to accept an edge of a first of the glass panels, and the second of the retaining channels configured to accept an edge of a second of the glass panels, panel securing means for securing the first and second panel edges within the first and second channels, respectively, and profile securing means for securing the profile coextensively along the framing member, such that one side of the pair of retaining channels is urged against the framing member.

The elongate retaining channels provide means for retaining glass panels in place during the application of structural adhesive, and also serve as means for retaining the edges of glass panel in the event that structural adhesive should fail. Weathersealing is also provided by the existence of strategically placed pads intended for contact with the smooth glass surface.

Therefore it is an object of this invention to provide a retainer and weatherseal between adjacent glass panels in a curtainwall framing system having structurally bonded glazing.

It is another object to provide such a retainer which permits structurally bonded glazing to be installed on curtainwall framing entirely from the interior of a building and which eliminates any need to weather seal the glass panels working from the building exterior.

It is another object to provide such a retainer which adjacent glass panels while their structural adhesive bonding cures, thereby eliminating necessity for temporary retainers.

It is another object to provide such a retainer which aesthetically does not detract from the smooth, unbroken appearance of structurally bonded glazing.

It is another object to provide such a retainer which enhances the structural integrity of the adhesively bound glass panels without detracting from the smooth, unbroken appearance of the glass panels.

It is another object to provide such a retainer which tolerates non-plumb installation of glass panels.

Other objects, features and advantages of the invention will become apparent upon reading the following detailed description in conjunction with the drawings and the claims.

DETAILED DESCRIPTION OF THE PREFERRED EMBODIMENT

Figure 1:
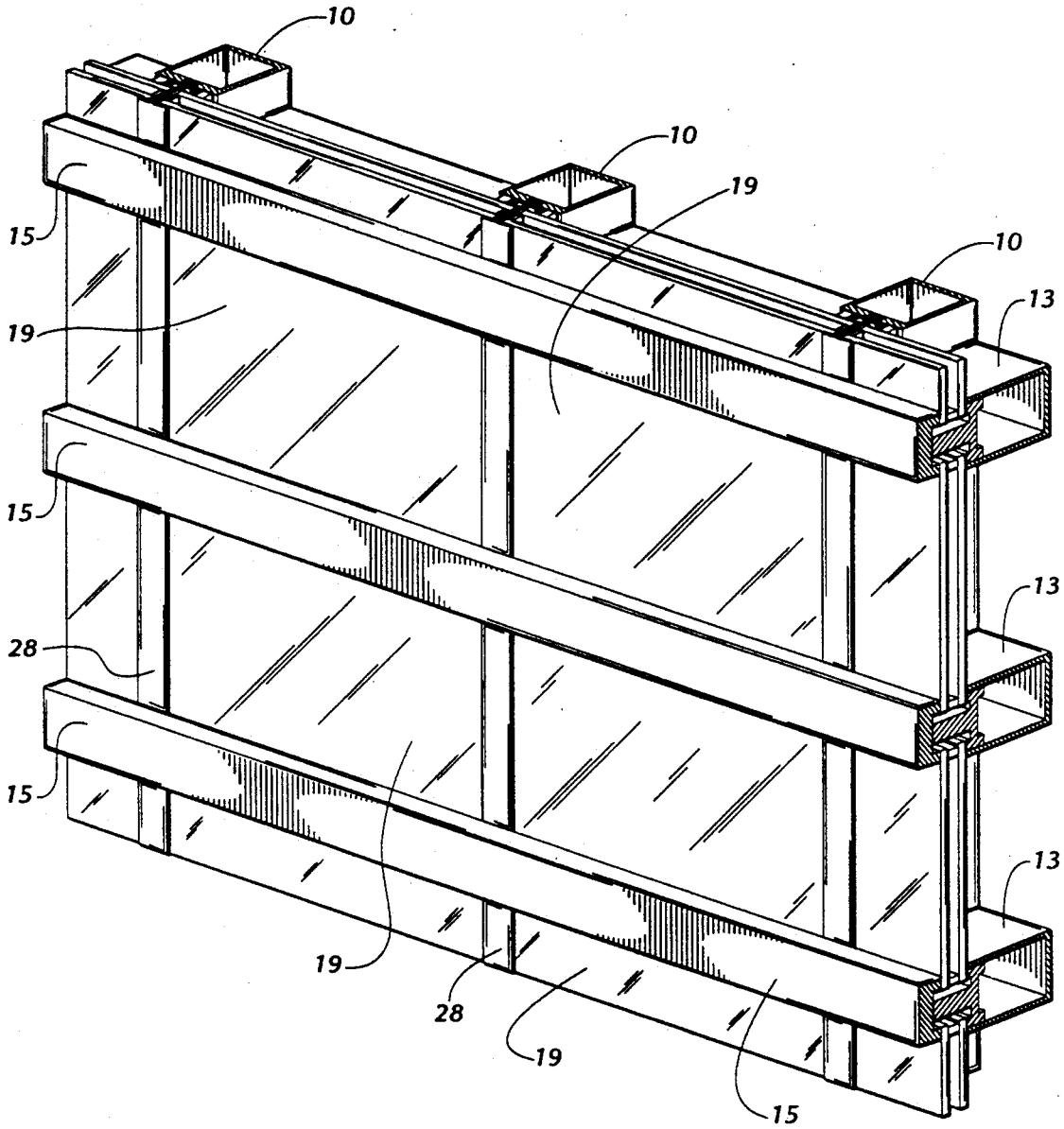
FIG. 1 is a pictorial view of a representative portion of the curtainwall framing system as viewed from the exterior.

Referring more particularly to the drawings, in which like numerals represent like parts throughout the separate views, FIG. 1 shows a representative portion of a "two-sided" SSG curtainwall framing system including vertical framing members 10, horizontal framing members 13, horizontal exterior retention members 15, a glass panel or panels 19, and vertical retainers 28.

Vertical framing members 10 may be linked together by means known in the art to horizontal framing members 13 to form a substantially rigid framework to which the plurality of glass panels 19 may be attached.

Figure 3:
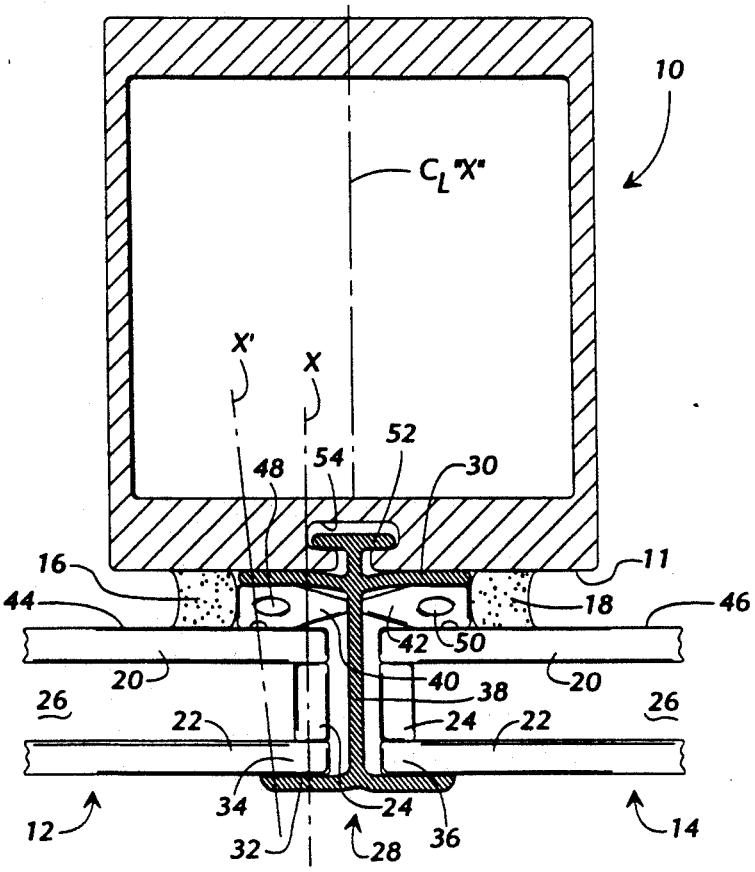
FIG. 3 is similar in view to FIG. 2, except that the spacers and structural adhesive are shown in place.

The weight of each of the glass panels 19 is supported by shelves attached to or an integral part of the horizontal frame members 13, as known in the art. As this is a two-sided SSG system, two edges of each glass panel, in this case the horizontal edges, are retained by horizontal exterior retention members 15, such as is known in the art. The other, in this case, vertical edges of the glass panels are captured and retained by retainers 28, as discussed in further detail later in this application. FIG. 3 shows a transverse cross section through a vertical framing member 10, an elongate profile extruded of architectural aluminum. Adjacent glass panels 12 and 14 are secured to the outward face 11 of the framing member 10 by structural adhesive beads 16 and 18, respectively. In the preferred embodiment, the structural adhesive is structural silicone adhesive. Each glass panel has dual panes, specifically, interior and exterior panes 20, 22, respectively, separated and linked as known in the art by a glass spacer 24 along the edges of the panel so as to form an air space 26 between the panes 20 and 22 for thermal insulation purposes. The silicone beads 16, 18 extend along the height of the glass panels 12, 14, to sufficiently bond the panels to the vertical framing member 10.

A retainer 28 provides mechanical retention of the adjacent glass panels 12, 14 to the framing member 10 to facilitate installation of the silicone beads 16, 18, as discussed in further detail below, and also to provide a safety feature should the silicone adhesive fail. The retainer 28 is elongate and extends lengthwise along the framing member 10. The elongate retainer 28 has a generally I-shaped transverse cross section (not including its "T"-shaped securing head 52) which forms a pair of opposing elongate channels 58, 60 (see FIG. 4), each configured to accept the edge of a corresponding glass panel 12, 14 and also to accept a corresponding spacer 40, 42.

The retainer 28 includes a generally planar base element 30 which, when installed, is urged against the outward face 11 of the vertical framing member 10. The retainer 28 also includes a generally planar foot element 32 which, when installed, contacts the exterior vertical edges 34 and 36 of the adjacent glass panels 12 and 14. The base element 30 and foot element 32 are spaced apart by a generally planar spine element 38 by a distance roughly equal to the combined thickness of the glass panel 12 and the spacer 40. It should be understood that in the preferred embodiment of the retainer in its unloaded configuration as shown in FIG. 4, the primary planar surfaces of the spine 38 are substantially perpendicular to the primary planar surfaces of the base element 30 and the foot element 32.

Figure 4:
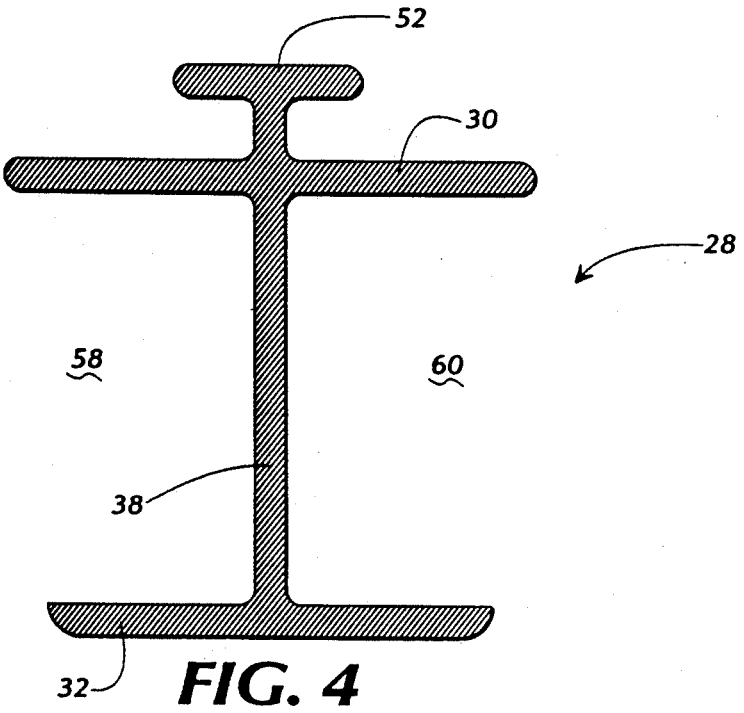
FIG. 4 is an isolated cross-sectional view of a first preferred embodiment of the retainer of the present invention.

Referring to FIG. 4, a first preferred embodiment of the retainer according to the present invention is shown as 28.

Referring now to FIG. 3, elongate resilient spacers 40 and 42, when installed, are wedged between the base element 30 of the retainer and the interior edges 44 and 46 of the glass panels, and are positioned within the channels 58, 60 defined by the retainer. Each spacer 40, 42 in transverse cross section has a leading wedge-shaped nose to facilitate its insertion and has an interior compression void 48, 50, respectively, provided to enhance deformability. The spacers 40, 42, are elongate and coextensive with the silicone bead and the framing member, and, when in position, provide opposing forces sufficient to urge its associated glass panel outwardly and securely against the foot element 32 of the retainer. When the spacers 40, 42 are in place, they also urge the outside edges of the glass panels 12, 14, respectively, against the foot 32 of the retainer 28. As may be seen, axes X and X' intersect elements 12, 40, 30, and 10 (at 11), in FIG. 3.

Figure 2:
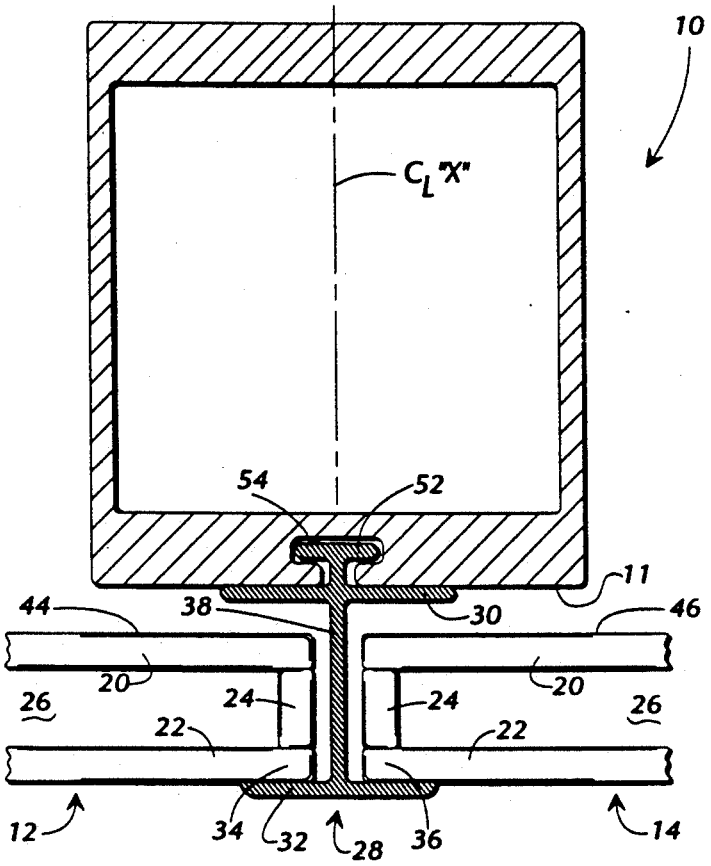
FIG. 2 is a horizontal cross-sectional view through a curtainwall framing system according to a first preferred embodiment of the present invention, including a vertical framing member, a first preferred embodiment retainer, and two glass panels. However, spacers and structural adhesive according to the present invention are not yet in place.

As previously discussed, the retainer 28 includes a securing head 52 extending from the center of the retainer base element 30 opposite the foot element 32. The securing head 52 has a T-shaped transverse cross section and extends lengthwise along the retainer 28. The securing head 52 is configured for engagement with a reciprocal T-shaped channel 54 defined by framing member 10. As will be discussed in further detail later in this application, T-shaped securing head 52 may slide freely within securing channel 54 when the spacers 40, 42 are not in position, such as shown in FIG. 2. However, when the spacers 40, 42 are in position as shown in FIG. 3, the securing head 52 is urged against the framing member 10 such that the frictional force between the elements 52, 10 effectively "locks" the elements together.

Installation of the overall assembly proceeds as follows. First, referring to FIG. 2, the securing head 52 of the elongate retainer 28 is slipped inside the securing channel 54 of the vertical framing member 10 and slidably positioned along the vertical framing member as desired. Then, the glass panels 12 and 14 are inserted into the U-shaped glazing channels 58 and 60 of the retainer 28, respectively, proceeding left to right, for example. Next, now referring to FIG. 3, the spacers 40 and 42 are wedged into place between the flanges of the base 30 of the retainer 28, and the glass panels 12, 14, respectively, thereby snugging the fit of the glass panels 12 and 14 inside the glazing channels 58 and 60 (see only FIG. 4) of the retainer.

It should be understood that when the spacers are wedged into place, the glass panels are urged outwardly against the foot 32 of the retainer 28. As the foot is urged outwardly, it will exert an outward force upon the spine 38 of the retainer, therefore tending to pull outwardly on the center of the base 30. However, the spacers are likewise providing an inward force against the outer edges of the base 30. Therefore, as shown in FIG. 3, the center of the base will tend to deflect downwardly somewhat relative to the outer edges of the base, which will remain in contact with the outer surface 11 of the frame member 10. Due to the geometry of the retainer 28, spacers 40, 42 and the securing channel 54, this deflection causes the T-shaped head 52 of the retainer to come into frictional contact with the securing channel 54, thus providing frictional securement between the retainer and the frame member 10.

Finally, the structural silicone beads 16 and 18 are gunned and tooled, as known in the art, into the space behind the wedge shaped spacers 40 and 42, thereby contacting the framing member 10 and the inside vertical edges 44 and 46 of the glass panels 12 and 14. Installation across the framing system continues left to right in a similar manner.

After the structural silicone cures, a strong structural adhesive bond is formed which provides primary support of the glass panels. However, should the silicone rupture, the retainer provides temporary support until the ruptured silicone bead can be repaired.

Figure 6:
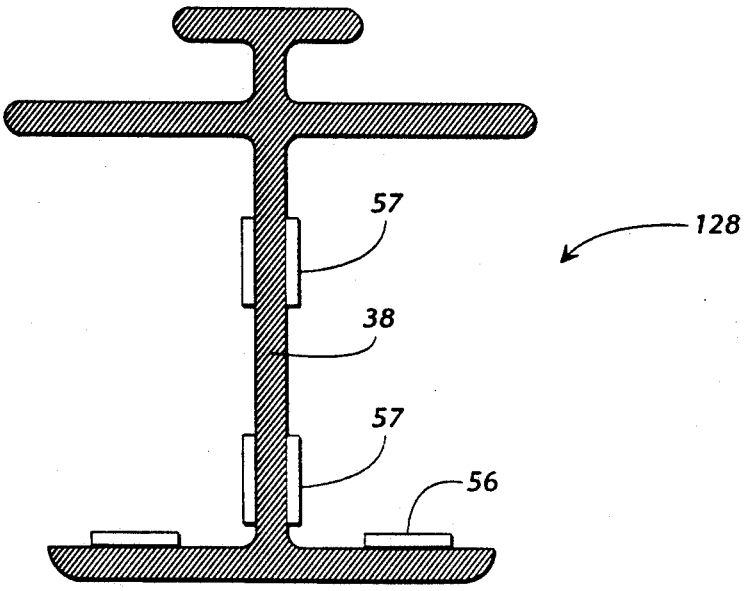
FIG. 6 is an isolated cross-sectional view of a second preferred embodiment of the retainer of the present invention.

Referring to FIG. 6, preferably, the second preferred retainer profile 128 includes cushion pads 56, 57, preferably coextruded as an integral part of retainer 28. The cushion pads 57, hereinafter referred to as "spine" cushion pads 57, protrude from the spine 38 of the retainer 128, and serve the purpose of cushioning contact between the retainer 128 and either of the glass panels 12 and 14 beyond that afforded by the resiliency of the retainer itself. This cushioning is especially effective when one of the glass panels 12, 14, is in contact with the retainer 128, and the other of the glass panels 12, 14 is brought into contact with the retainer. Cushioning pads 56, hereinafter referred to as foot cushioning pads 56, extend from the inside of the foot 32 of the retainer 128, and contact the outside surfaces of the glass panels when installed, providing a cushioning and weatherproofing function.

Figure 5:
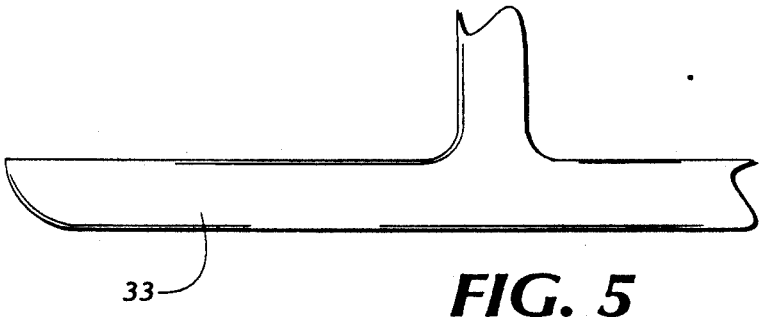
FIG. 5 is a partial close up view of that shown in FIG. 4.

Retainers 28 or 128 are each preferably coextruded profiles composed of different materials, with most of the retainer (the securing head, spine, head, and base) composed of a substantially rigid but deflectable and resilient compound polyvinyl chloride known in the art as CPVC, such as that sold under the brand name "Temprite 88997". The pads 56, 57, if used, are preferably composed of dense elastomeric material, deformable but resilient, such as that known as "ALCRYN", manufactured by Dupont. The outside surface of the foot 32 (see FIG. 5) may be provided with a coextruded layer 33 of semirigid polyvinyl chloride, treated as known in the art to be "UV resistant" (capable of resisting deterioration due to ultraviolet light exposure).

The spacers 40, 42 are preferably extruded from an elastomeric rubber material (compatible with structural silicone) being deformable but resilient.

Therefore it may be seen that the present invention provides a simple, cost-efficient, and reliable retainer assembly for effective retention and weathersealing of glass panels in structural silicone adhesive systems. The retainer assembly may be installed from the inside of the building, thus obviating the need for exterior scaffolding. The retainer assembly maintains glass panels in place during the application of structural adhesive, and also acts as a safety means should the adhesive fail. The portion of the retainer assembly viewable from the exterior of the building is unobtrusive, thus providing a desirable smooth outside appearance.

While the invention has been described in detail with particular reference to the disclosed embodiments, it is to be understood that variations and modifications may be utilized without departing from the principles and scope of the invention as defined by the following claims.

What is claimed is:

1. An apparatus for accepting edges of substantially planar panels and retaining said edges relative to a framing member, comprising:

a deformable but resilient elongate extruded retainer profile having a generally H-shaped transverse cross section, thereby forming a pair of elongate U-shaped retaining channels, the first of said retaining channels configured to accept an edge of a first of said panels, and the second of said retaining channels configured to accept an edge of a second of said panels;

panel securing means for securing said first and second panel edges within said first and second channels, respectively, said panel securing means comprising first and second elongate resilient spacers, said first and second spacers each positioned against corresponding said first and second panels and within and against corresponding said first and second U-shaped channels such that said spacers maintain said panels within said U-shaped channel by frictional force;

profile securing means for securing said profile coextensively along said framing member, such that one side of said pair of retaining channels is urged against said framing member; and deformable but resilient cushion pads in said U-shaped channels at the locations of contact between said channels and said panels.

2. The apparatus of claim 1, wherein said retainer profile includes a securing head, and wherein the profile of said framing member defines a cavity configured for interlocking connection with said securing head, wherein said retainer securing means comprises the interconnection of said securing head and said cavity.

3. The apparatus of claim 2, wherein said securing head has a T-shaped transverse cross-sectional profile.

4. The apparatus of claim 1, wherein said retainer profile includes a securing head, and wherein the profile of said framing member defines a cavity configured for interlocking connection with said securing head, wherein said retainer securing means comprises the interconnection of said securing head and said cavity.

5. The apparatus of claim 4, wherein said securing head has a T-shaped transverse cross-sectional profile.

6. A building construction for accepting a marginal edge of a glass panel and for retaining said marginal edge, said building construction comprising:

an elongated frame member, said frame member defining an outwardly facing front surface portion;

an elongated retainer member comprising a spine and a foot member formed at the outward edge of said spine, said spine and said foot member at least partially defining a retaining channel, said marginal edge of said glass panel being received within said glazing recess such that said front surface portion, said marginal edge of said glass panel, and said foot member all intersect a first axis;

a spacer portion, separate from said retainer member, also intersecting said first axis for contacting said glass panel and biasing said glass panel against said foot member, such that said glass panel tends to be maintained in place; and structural adhesive to provide a bond intermediate a substantially flat bonding surface defined by said frame member and a substantially flat bonding surface defined by said glass panel, said substantially flat bonding surface defined by said frame member being substantially parallel to and at least partially facing said substantially flat bonding surface defined by said glass panel.

7. The construction claimed in claim 6, wherein said retainer member further comprises a transverse base flange intersecting said first axis, said flange positioned between said spacer portion and said front surface of said frame member.

8. The construction claimed in claim 7, wherein said spacer portion is between said spine and said structural adhesive.

9. The construction claimed in claim 7, wherein said structural adhesive is in contact with said spacer portion, said glass panel, and said front surface portion of said frame member.

10. The construction claimed in claim 6, wherein said spacer portion is between said spine and said structural adhesive.

11. The construction claimed in claim 6, wherein said structural adhesive is in contact with said spacer portion, said glass panel, and said front surface portion of said frame member.

12. The construction claimed in claim 6, wherein said spacer portion defines two oppositely facing, substantially parallel surface portions, which provide opposing forces when in place to provide said biasing.

13. The construction claimed in claim 12, wherein said spacer portion is between said spine and said structural adhesive.

14. The construction claimed in claim 12, wherein said structural adhesive is in contact with said spacing portion, said glass panel, and said front surface portion of said frame member.

15. An apparatus for accepting edges of substantially planar panels and retaining said edges relative to the outside surface of a framing member, comprising:

an elongate retainer profile having a generally H-shaped transverse cross section, thereby forming a pair of elongate U-shaped retaining channels, the first of said retaining channels configured to accept an edge of a first of said panels, and the second of said retaining channels configured to accept an edge of a second of said panels;

panel securing means for securing said first and second panel edges within said first and second channels, respectively, said panel securing means comprising first and second elongate resilient spacer portions, said first and second spacer portions each positioned against corresponding said first and second panels and within and against corresponding said first and second U-shaped channels such that said spacer portions each contact a corresponding panel and at least partially maintain said panels within said U-shaped channels by frictional force;

structural adhesive to provide interconnection intermediate said glass panel and said outside surface of said framing member, said structural adhesive providing a bond intermediate a substantially flat bonding surface at least partially defined by said outside surface of said frame member and a substantially flat bonding surface defined by said glass panel, said substantially flat bonding surface defined by said frame member being substantially parallel to and at least partially facing said substantially flat bonding surface defined by said glass panel; and profile securing means for securing said profile coextensively along said framing member.

16. The apparatus of claim 15, wherein said retainer is deformable but resilient, and of an extruded profile.

17. An apparatus for accepting edges of substantially planar glass panels and retaining said edges relative to a framing member defining a substantially planar surface portion and defining a securing channel having a surface portion, said apparatus comprising:

an elongate retainer profile itself comprising:

a) a central spine having two opposing ends, b) a securing head extending from one end of said spine and defining a surface portion facing generally toward the other end of the spine, said head configured for sliding engagement along and within said securing channel with said surface portion of said securing portion facing said surface portion of said securing head;

c) a foot member extending from a second end of said spine; and d) a pair of base flanges extending from said spine in an opposing manner from a position along said spine such that a pair of oppositely disposed retaining channels are at least partially defined by said spine, a corresponding base flange, and said foot member, each retaining channel configured to receive an edge portion of a corresponding one of said planar glass panels; and first and second spacer portions each positioned between a corresponding glass panel and a corresponding base flange, said spacer portions configured and positioned to urge their corresponding glass panel against said foot member to enhance frictional engagement between said glass panel and said foot member, and said spacer portions configured and positioned such that said foot member transfers force through said spine sufficient to enhance frictional engagement between said surface portion of said securing portion and said surface portion of said securing head.

18. The apparatus of claim 17, wherein said spacer portions are deformable but resilient and are deformed when installed between said corresponding glass panel and corresponding base flanges with said spacer portions providing opposing outward forces against said corresponding glass panels and corresponding base flanges, said forces on said base flanges being sufficient to maintain a portion of each of said base flanges in frictional contact with said planar surface of said framing member.

19. The apparatus as claimed in claim 18, wherein said foot member includes a pair of substantially opposing flanges each disposed at a substantially right angle relative to said spine, wherein each of said glass panels is urged against a corresponding one of said head flanges by a corresponding one of said spacer portions.

20. The apparatus of claim 19, wherein said retainer is deformable but resilient, and of an extruded profile.

21. The apparatus of claim 20, further comprising deformable but resilient cushion pads in said retaining channels at the locations of contact between said channels and said panels.

22. The apparatus of claim 18, wherein said retainer is deformable but resilient, and of an extruded profile.

23. The apparatus of claim 22, further comprising deformable but resilient cushion pads in said retaining channels at the locations of contact between said channels and said panels.

24. The apparatus as claimed in claim 18, wherein said foot member includes a pair of substantially opposing flanges each disposed at a substantially right angle relative to said spine, wherein each of said glass panels is urged against a corresponding one of said foot flanges by a corresponding one of said spacer portions.

25. The apparatus of claim 17, wherein said retainer is deformable but resilient, and of an extruded profile.

26. The apparatus of claim 25, further comprising deformable but resilient cushion pads in said retaining channels at the locations of contact between said channels and said panels.

27. The apparatus of claim 26, wherein said retainer is deformable but resilient, and of an extruded profile.

28. The apparatus of claim 17, further comprising deformable but resilient cushion pads in said retaining channels at the locations of contact between said channels and said panels.

29. The apparatus of claim 28, further comprising deformable but resilient cushion pads in said retaining channels at the locations of contact between said channels and said panels.

30. The apparatus of claim 17, further comprising deformable but resilient cushion pads in said retaining channels at the locations of contact between said channels and said panels.

31. An elongate retainer member for use in conjunction with an elongated frame member for accepting a marginal edge of a glass panel and for retaining said marginal edge relative to said frame member, said frame member defining a front surface portion and defining a securing channel, said securing channel having an inwardly facing wall portion, said elongate retainer member comprising:

a spine;

a transverse base flange;

a securing head formed at a rearward edge of said spine, said securing head being slidably received within said securing channel of said frame member such that a portion of said securing head faces said inwardly facing wall portion of said securing channel;

a foot member formed at the forward edge of said spine, said spine and said foot member at least partially defining a retaining channel, said marginal edge of said glass panel being received within said retaining channel such that said front surface portion, said marginal edge of said glass panel, said base flange, and said foot member all intersect a first axis; and a resilient spacer portion also intersecting said first axis for biasing said foot member outward so as to encourage frictional engagement between said portion of said securing head and said inwardly facing wall of said securing channel, said spacer portion positioned such that said flange is positioned between said spacer portion and said front surface of said frame member.

32. The construction claimed in claim 31, further comprising structural adhesive to provide a bond between said frame member and said glass panel.

33. The construction claimed in claim 31, wherein said spacer portion is between said spine and said structural adhesive.

34. The construction claimed in claim 31, wherein said structural adhesive is in contact with said spacer portion, said panel member, and said front surface portion of said frame member.

35. The construction claimed in claim 31, wherein said structural adhesive is in contact with said spacer portion, said panel member, and said front surface portion of said frame member.

36. An elongate retainer member, spacer member, and silicone adhesive for use in conjunction with an elongated frame member for accepting a marginal edge of a glass panel and for retaining said marginal edge relative to said frame member, said frame member defining a front surface portion and defining a securing channel, said securing channel having an inwardly facing wall portion, comprising:

a) an elongate retainer member itself comprising:
   a spine;
   a securing head formed at a rearward edge of said spine, said securing head being slidably received within said securing channel of said frame member such that a portion of said securing head faces said inwardly facing wall portion of said securing channel; and
   a foot member formed at the forward edge of said spine, said spine and said foot member at least partially defining a glazing recess, said marginal edge of said glass panel being received within said glazing recess such that said front surface portion, said marginal edge of said glass panel, and said foot member all intersect a first axis;
b) a resilient spacer portion contacting said glass panel, separate from said retainer member and also intersecting said first axis for biasing said foot member outward so as to encourage frictional engagement between said portion of said securing head and said inwardly facing wall of said securing channel; and
c) structural adhesive to provide a bond between said frame member and said glazing member, said structural adhesive providing a bond intermediate a substantially flat bonding surface at least partially included in said outside surface of said frame member and a substantially flat bonding surface defined by said glass panel, said substantially flat bonding surface defined by said frame member being substantially parallel to and at least partially facing said substantially flat bonding surface defined by said glass panel.

37. The construction claimed in claim 36, wherein said spacer portion is between said spine and said structural adhesive.

38. An elongate retainer member for use in conjunction with an elongated frame member for accepting a marginal edge of a glass panel and for retaining said marginal edge relative to said frame member, said frame member defining a front surface portion and defining a securing channel, said securing channel having an inwardly facing wall portion, said elongate retainer member comprising:

a spine;
a securing head formed at a rearward edge of said spine, said securing head being slidably received within said securing channel of said frame member such that a portion of said securing head faces said inwardly facing wall portion of said securing channel;
a foot member formed at the forward edge of said spine, said spine and said foot member at least partially defining a retaining channel, said marginal edge of said glass panel being received within said retaining channel such that said front surface portion, said marginal edge of said glass panel, and said foot member all intersect a first axis;
structural adhesive to provide a bond between said frame member and said glass panel; and
a resilient spacer portion also intersecting said first axis for biasing said foot member outward so as to encourage frictional engagement between said portion of said securing head and said inwardly facing wall of said securing channel, said spacer portion defining two oppositely facing, substantially parallel surface portions, which provide opposing forces when in place to provide said biasing.

39. The construction claimed in claim 38, wherein said spacer portion is between said spine and said structural adhesive.

40. The construction claimed in claim 38, wherein said structural adhesive is in contact with said spacer portion, said glass panel, and said front surface portion of said frame member.

41. An apparatus for accepting edges of substantially planar panels and retaining said edges relative to a framing member, comprising:

a deformable but resilient elongate extruded retainer profile having a generally H-shaped transverse cross section, thereby forming a pair of elongate U-shaped retaining channels, the first of said retaining channels configured to accept an edge of a first of a said panels, and the second of said retaining channels configured to accept an edge of a second of said panels;
panel securing means for securing said first and second panel edges within said first and second channels, respectively;
profile securing means for securing said profile coextensively along said framing member, such that one side of said pair of retaining channels is urged against said framing member; and
deformable but resilient cushion pads in said U-shaped retaining channels at the locations of contact between said channels and said panels.

* * * * *